US006006936A

United States Patent [19]

Przybylowicz

[11] Patent Number: 6,006,936

[45] Date of Patent: Dec. 28, 1999

[54] MUD PAN FOR USE IN DRY WALL CONSTRUCTION

[76] Inventor: Wojciech Przybylowicz, 2622 G Park Rd., Charlotte, N.C. 28209

[21] Appl. No.: 09/036,768

[22] Filed: Mar. 9, 1998

[51] Int. Cl.[6] ..... B65D 25/04

[52] U.S. Cl. ..... 220/23.8; 220/475; 220/503; 220/505

[58] Field of Search ..... 220/475, 505, 220/503, 507, 553, 555, 570, 23.8

[56] References Cited

U.S. PATENT DOCUMENTS

| | | | |
|---|---|---|---|
| 3,112,729 | 12/1963 | Prezioso, Jr. | 220/570 |
| 3,820,656 | 6/1974 | Orr | 220/505 |
| 3,837,034 | 9/1974 | Leffert et al. | 220/570 |
| 4,164,299 | 8/1979 | Fuhr | 220/570 |
| 4,436,214 | 3/1984 | Henderson | 220/475 |
| 4,729,489 | 3/1988 | Papaianni | 220/23.8 |
| 4,995,529 | 2/1991 | Sher | 220/475 |
| 5,067,626 | 11/1991 | Leumi | 220/475 |
| 5,498,120 | 3/1996 | Adams . | |
| 5,511,279 | 4/1996 | Ippolito | 220/570 |

*Primary Examiner*—Stephen Castellano
*Attorney, Agent, or Firm*—Clifton T. Hunt

[57] ABSTRACT

The mud pan of this invention includes the usual trough, with a bottom wall, parallel end walls and side walls diverging upwardly from the bottom wall, and a waste receptacle comprising an outer wall that extends in diverging relation from one side wall of the trough. The worker is thus enabled to easily and efficiently dispose of dirty mud by scraping a putty knife with dirty mud against the outer wall of the waste receptacle instead of creating a mess by slinging the dirty mud on the floor. The contents of a filled waste receptacle will be periodically dumped at a suitable location, such as a nearby barrel.

8 Claims, 2 Drawing Sheets

MUD PAN FOR USE IN DRY WALL CONSTRUCTION

FIELD OF THE INVENTION

This invention relates to containers of joint compound and the like that are held by workers, such as dry wall finishers and plasterers, while taking the compound from the container and applying it to a surface being treated.

BACKGROUND OF THE INVENTION

The most pertinent prior art known to applicant is an elongated trough (known in the trade as a "mud pan") with a bottom wall, parallel end walls and side walls diverging upwardly from the bottom wall. See also the prior art disclosed in the following patents:

| Number | Date | Inventor | Title |
|---|---|---|---|
| 1,348,516 | Aug 3, 1920 | Peck | RESILIENT SUPPORT FOR PLASTERER'S HAWKS |
| 2,535,726 | Dec 26, 1950 | Dalton | PLASTERER'S HAWK |
| 3,090,984 | May 28, 1963 | Dunnigan | IMPLEMENT FOR OVERHEAD TOOL MANIPULATION |
| 3,790,201 | Feb 5, 1974 | Morsilli | HAWK |
| 4,241,470 | Dec 30, 1980 | Herzig | MORTAR TROUGH |
| 4,753,471 | June 28, 1988 | Gringer | HAWK HAVING MULTIPOSITION HANDLE |
| 5,406,671 | Apr 18, 1995 | Green | TROWEL |

SUMMARY OF THE INVENTION

In dry wall construction, a worker uses a trough to hold a supply of joint compound while applying joint compound to the joints between panels before and after covering the joint with tape. The worker uses a putty knife to dip joint compound from the trough and apply the joint compound to the wall. Some of the joint compound remains on the putty knife after each application of the joint compound to the wall. The joint compound that remains on the putty knife after applying a layer to a wall is commonly referred to in the trade as "dirty mud". It is standard practice in the trade to dispose of the dirty mud by slinging it on the floor before dipping the putty knife into the trough for another load of joint compound.

The mud pan of this invention includes the usual trough, with a bottom wall, parallel end walls and side walls diverging upwardly from the bottom wall, and a waste receptacle comprising an outer wall that extends in diverging relation from one side wall of the trough. The worker is thus enabled to easily and efficiently dispose of dirty mud by scraping a putty knife with dirty mud against the outer wall of the waste receptacle instead of creating a mess by slinging the dirty mud on the floor. The contents of a filled waste receptacle will be periodically dumped at a suitable location, such as a nearby barrel.

In one embodiment of the invention, the waste receptacle has end walls joined to the end walls of the trough. In another embodiment of the invention, the waste receptacle has only one end wall, leaving the other end open to facilitate removal of the dirty mud.

A third embodiment of the invention includes one or more sockets extending downwardly from the bottom wall of the trough to receive a pole for supporting the mud pan. The illustrated embodiment of the invention shows two sockets depending from the bottom wall of the trough. One socket extends straight down to receive a pole resting on the floor, and the other socket extends from the bottom wall at an angle to hold the mud pan against a wall.

DETAILED DESCRIPTION OF THE INVENTION

Figure 1:
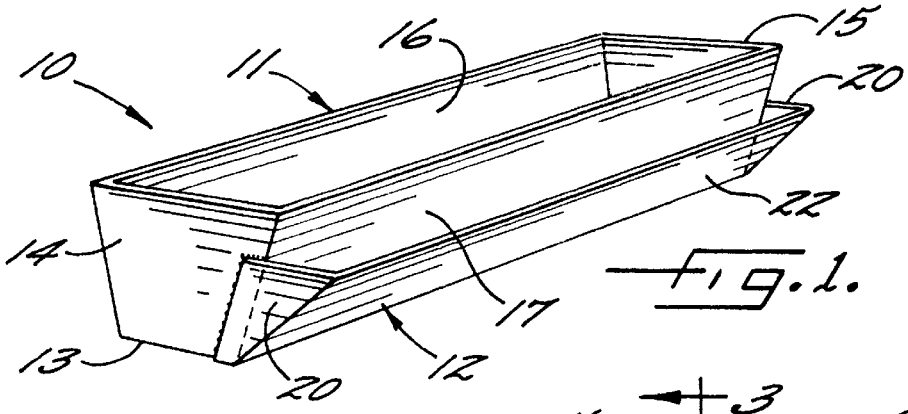
FIG. 1 is a perspective view showing one embodiment of the mud pan of this invention, looking at the top, one end and one side of the mud pan.
Figure 2:
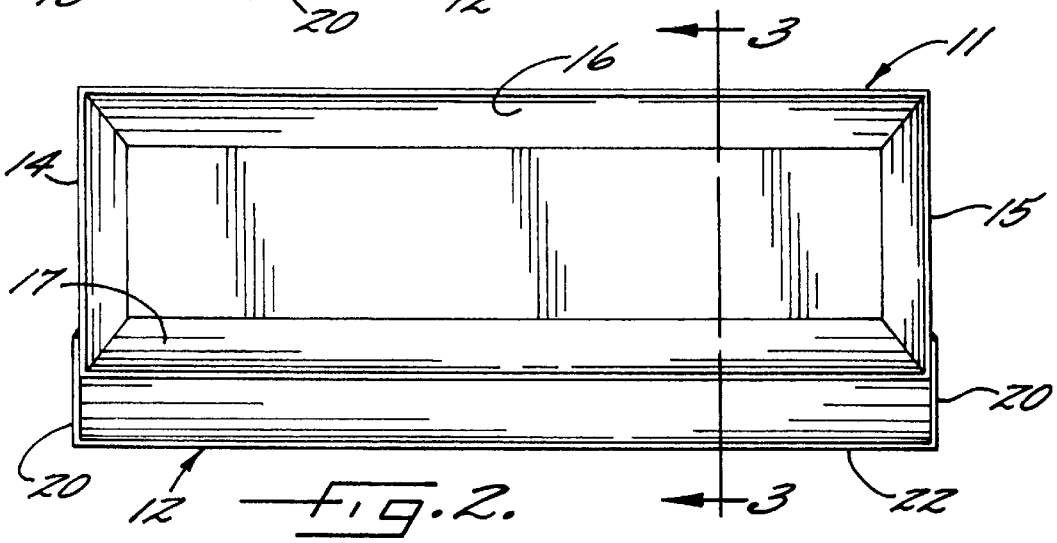
FIG. 2 is a top view of the mud pan shown in FIG. 1.

Referring to FIGS. 1–4, one embodiment of this invention is a mud pan 10 comprising a trough broadly indicated at 11 and a waste receptacle broadly indicated at 12.

The trough 11 comprises a bottom wall 13, end walls 14 and 15 extending in parallel relation to each other from the bottom wall 13, and side walls 16 and 17 diverging upwardly from the bottom wall 13 and joined to the end walls 14 and 15.

Figure 3:
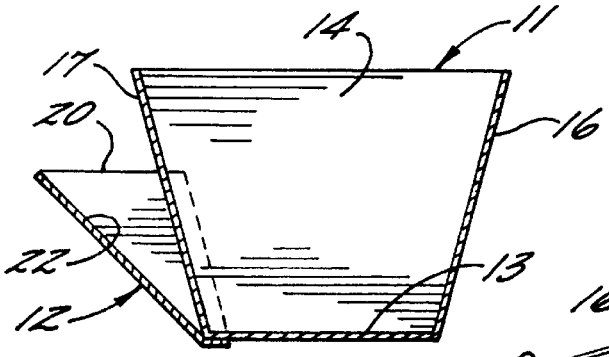
FIG. 3 is a sectional view taken substantially along the line 3—3 in FIG. 2.

The waste receptacle 12 is defined by the side wall 17 of the trough 11, end walls 20 and 21 extending laterally from the end walls 14, 15 of the trough 11, and is an outer wall 22 diverging upwardly from the bottom wall 13 of the trough 11 in increasingly spaced relation to the side wall 17 of the trough 11 (FIG. 3).

Figure 4:
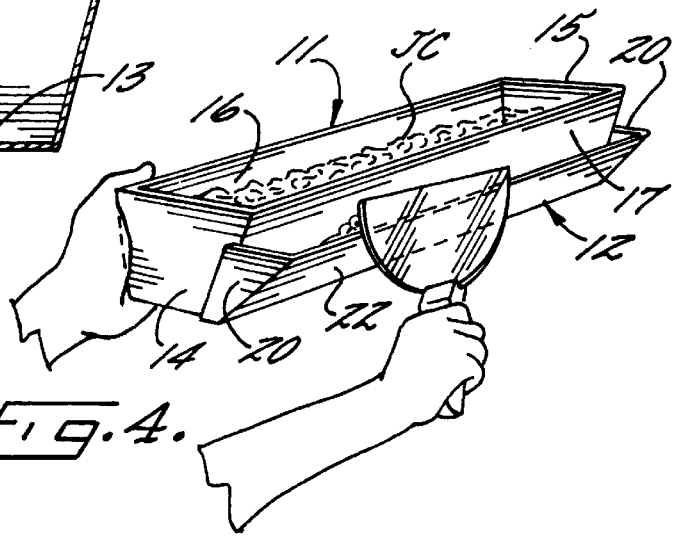
FIG. 4 is a perspective view like FIG. 1, illustrating use of the waste receptacle.
Figure 8:
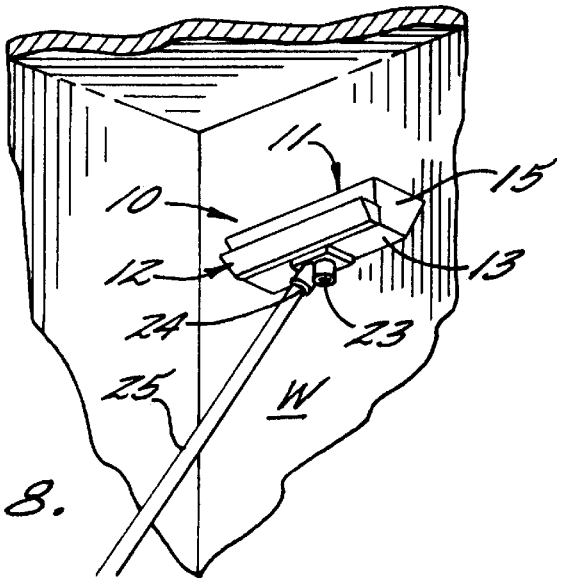
FIG. 8 is a perspective view illustrating one use of the third embodiment of the mud pan.

When the trough 11 is filled with a joint compound JC, as seen in FIG. 4, a worker holds the mud pan 10 in one hand and a suitable applicator, such as a putty knife PK, in the other hand while applying the joint compound to a wall, such as indicated at W in FIG. 8.

The worker first loads the putty knife PK with joint compound JC by dipping the putty knife into the trough 11 and withdrawing the putty knife loaded with joint compound. The worker then applies joint compound on the putty knife to the wall by stroking the putty knife along the wall with the joint compound on the putty knife pressed against the wall. A layer of joint compound JC is thus applied to a portion of the wall, but some of the joint compound remains on the putty knife PK. The residual joint compound that remains on the putty knife may have been soiled by contact with the wall and foreign matter on the wall. The residual joint compound on the putty knife is known as "dirty mud", broadly indicated at DM in FIG. 4, and is generally removed from the putty knife by slinging it to the floor. This results in an accumulation of dirty mud on the floor that requires an undesirable expenditure of time and money to remove.

According to the invention, the dirty mud DM is removed from the putty knife by scraping the putty knife against the outer wall 22 of the waste receptacle 12, as seen in FIG. 4.

The process is repeated as often as necessary to complete the job by dipping the putty knife into the trough to get a fresh supply of joint compound and applying it to the wall before scraping the residual dirty mud into the waste receptacle. The mud pan 10 is periodically carried to a suitable disposal site, not shown, for suitable disposal of the dirty mud when the waste receptacle 12 becomes filled with dirty mud DM. A suitable disposal site may be a conveniently located barrel.

Figure 5:
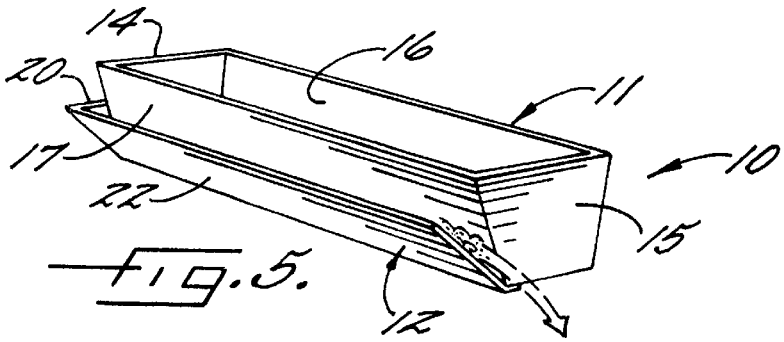
FIG. 5 is a perspective view of a second embodiment of the mud pan, looking at the top, one side and one end of the mud pan.

FIG. 5 illustrates a second embodiment of the invention, wherein one end wall, such as the end wall 21, is removed from the waste receptacle 12 to create an open-ended waste receptacle that facilitates removal of the dirty mud DM from the waste receptacle at the disposal site. The mud pan 10 is tilted in use to elevate the open end of the waste receptacle 11 and thereby prevent the dirty mud DM from prematurely spilling from the waste receptacle before reaching the disposal site.

Figure 6:
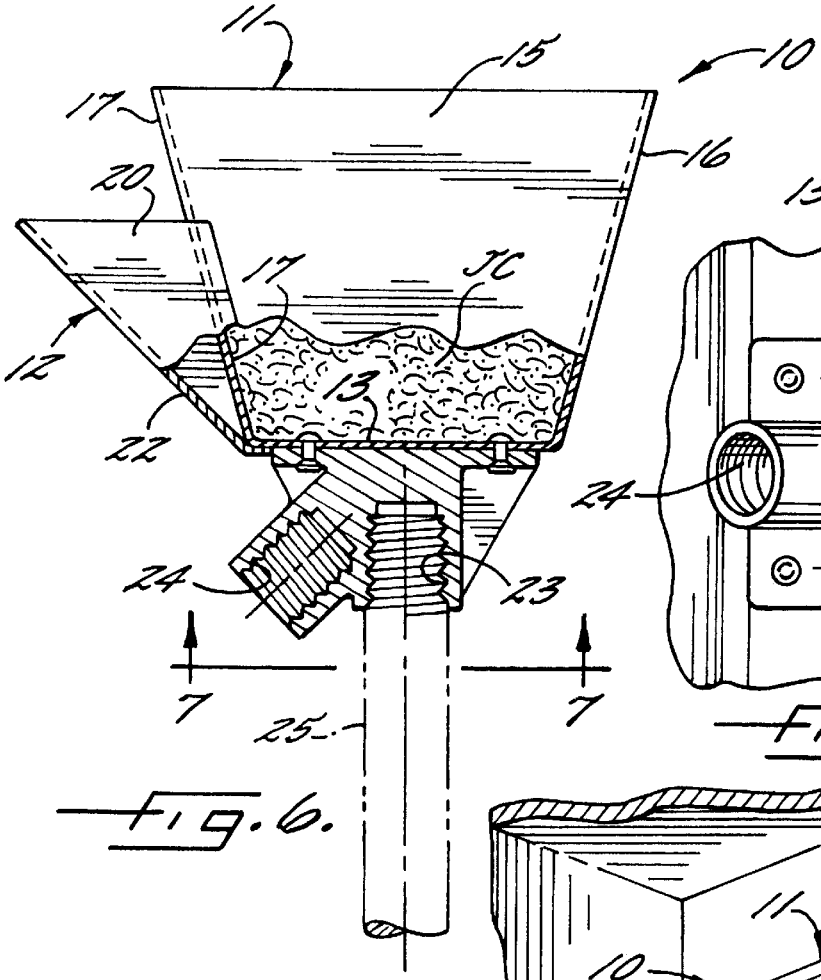
FIG. 6 is an end view, partially in section, of a third embodiment of the mud pan.
Figure 7:
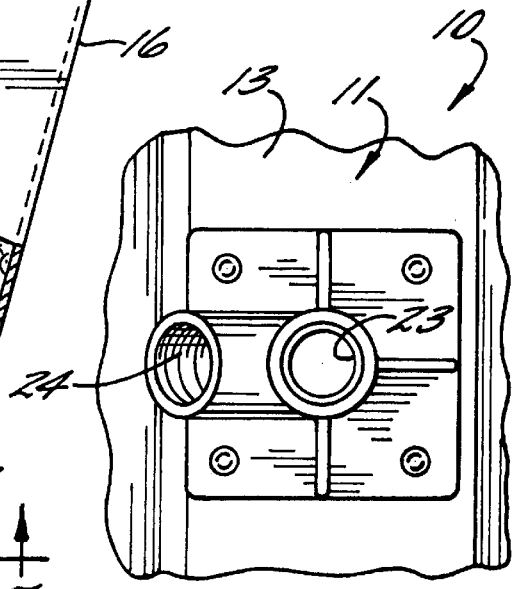
FIG. 7 is a sectional view taken substantially along the line 7—7 in FIG. 6.

FIG. 6 illustrates the third embodiment of the invention, wherein threaded sockets 23 and 24 are fastened to the bottom wall 13 of the trough 11. The sockets 23 and 24 may be applied to the trough 11 in the embodiment of FIG. 1 and in the embodiment of FIG. 5. The threaded sockets are provided for the reception of correspondingly threaded ends of poles, one of which is indicated in phantom lines at 25 in FIG. 6 and in solid lines in FIG. 8.

The socket 23 depends from the bottom wall 13 in perpendicular relation to the wall 13 for the purpose of receiving a pole 25 of a suitable length to rest on the floor and support the weight of the mud pan 10 at a convenient elevation for the worker. The worker holds the pole to steady the mud pan 10 while applying joint compound from the trough 11 to the wall W, scraping dirty mud into the waste receptacle 12, and emptying the dirty mud at the disposal site.

The socket 24 extends at an angle of approximately 45° from the bottom wall 13 of the trough 11 for the purpose of receiving a suitably threaded pole to hold the mud pan 10 against a wall W, as shown in FIG. 8.

There is thus provided a mud pan that combines the advantages of the prior art with the labor saving advantages of the waste receptacle that eliminates, or at least reduces, the effort and cost of cleaning after the dry wall is constructed. The sockets provide an additional benefit in providing for the use of poles to reduce the strain of holding the mud pan.

Although specific terms have been used in describing the invention, they have been used in a generic and descriptive sense only and not for the purpose of limitation, the scope of the invention being defined in the following claims.

I claim:

1. A mud pan to be carried in one hand of a worker while applying joint compound with a putty knife held in the other hand, the mud pan comprising a trough and a waste receptacle wherein the trough includes a bottom wall, end walls and side walls diverging upwardly from the bottom wall, and the waste receptacle comprises an inner wall defined by one side wall of the trough, an outer wall diverging upwardly from the bottom wall of the trough a lesser distance than the inner wall of the waste receptacle and in increasingly spaced relation to the inner wall of the waste receptacle.

2. A mud pan according to claim 1 wherein the waste receptacle has only one end wall.

3. A mud pan according to claim 1 wherein the waste receptacle has two end walls.

4. A mud pan according to claim 1 which includes a pole for supporting the mud pan, and means for fastening the pole to the trough, wherein said means comprises a first socket fastened to and extending perpendicularly from the trough, and a second socket fastened to and extending at a selected angle from the trough.

5. A mud pan according to claim 4 wherein the means for connecting the pole to either socket comprises the interior of each socket being threaded, and the pole being correspondingly threaded.

6. A mud pan according to claim 1 which includes a pole for supporting the mud pan, and means for fastening the pole to the trough, wherein said means comprises an interiorly threaded socket fastened to and extending from the trough, and the pole being correspondingly threaded.

7. A mud pan comprising:

a trough including:
- a bottom wall, end walls and side walls diverging upwardly from the bottom wall;
- a waste pan including:
  - an inner wall defined by one side wall of the trough, one end wall and an outer wall diverging upwardly from the bottom wall of the trough in increasingly spaced relation to said one side wall of the trough;
  - a threaded socket extending perpendicularly from the bottom wall of the trough; and
  - a correspondingly threaded pole selectively engageable with the socket.

8. A mud pan according to claim 7 wherein a second socket extends at a selected angle from the bottom wall of the trough.

* * * * *